US007462117B2

(12) United States Patent
White et al.

(10) Patent No.: US 7,462,117 B2
(45) Date of Patent: Dec. 9, 2008

(54) GROUND ANCHOR FOR SPORTS SUPPORT POLE

(75) Inventors: Ronald White, North Prairie, WI (US); Peter Holewinski, Waukesha, WI (US)

(73) Assignee: Russell Corporation, Atlanta, GA (US)

( * ) Notice: Subject to any disclaimer, the term of this patent is extended or adjusted under 35 U.S.C. 154(b) by 303 days.

(21) Appl. No.: 11/345,324

(22) Filed: Feb. 2, 2006

(65) Prior Publication Data

US 2007/0178994 A1 Aug. 2, 2007

(51) Int. Cl.
*A63B 63/08* (2006.01)

(52) U.S. Cl. ..... 473/481; 52/116

(58) Field of Classification Search ..... 473/415, 473/476, 478, 479, 481; 362/269, 431; 52/28, 52/116; 174/45 R; 40/608; 116/173; 248/514
See application file for complete search history.

(56) References Cited

U.S. PATENT DOCUMENTS

| | | | | |
|---|---|---|---|---|
| 87,015 | A | | 2/1869 | Varian |
| 225,683 | A | | 3/1880 | Bragy |
| 416,368 | A | | 12/1889 | Jordan |
| 432,043 | A | | 7/1890 | Heiland |
| 592,660 | A | | 10/1897 | Miller |
| 611,568 | A | | 9/1898 | Dohme |
| 753,709 | A | | 3/1904 | Jones |
| 771,042 | A | | 9/1904 | Calkins |
| 837,820 | A | | 12/1906 | Folsom |
| 849,922 | A | | 4/1907 | Scofield |
| 982,380 | A | | 1/1911 | Martin |
| 1,020,396 | A | * | 3/1912 | Blank ..... 116/173 |
| 1,095,197 | A | | 5/1914 | Entenmann |
| 1,564,109 | A | | 12/1925 | Ponsolle |
| 1,606,697 | A | | 11/1926 | Dean |
| 1,611,935 | A | | 12/1926 | Mitchell |
| 1,742,481 | A | * | 1/1930 | Miller ..... 116/173 |
| 1,799,314 | A | | 4/1931 | Pfaff |
| 2,194,779 | A | | 3/1940 | Albach |
| 2,283,987 | A | | 5/1942 | Hammer |
| D139,311 | S | | 10/1944 | Gibson |
| 2,888,111 | A | | 5/1959 | Evans |
| 2,932,511 | A | | 4/1960 | Bemis |
| 2,945,659 | A | | 7/1960 | McDonald |
| 2,985,261 | A | | 5/1961 | Kubesh |
| 3,017,183 | A | | 1/1962 | Chalcroft |
| 3,170,721 | A | | 2/1965 | Wells |
| 3,311,333 | A | * | 3/1967 | Galloway ..... 52/295 |
| 3,318,560 | A | | 5/1967 | Garrette, Jr. |
| 3,342,444 | A | | 9/1967 | Nelson |
| 3,355,847 | A | | 12/1967 | Pratt |
| 3,417,525 | A | | 12/1968 | Dashio |
| 3,544,110 | A | | 12/1970 | Dickinson |
| 3,586,324 | A | | 6/1971 | Bearson |
| 3,671,738 | A | | 6/1972 | Beachley |
| 3,765,676 | A | | 10/1973 | Bearson et al. |

(Continued)

*Primary Examiner*—Gene Kim
*Assistant Examiner*—M Chambers

(57) ABSTRACT

The present invention relates to an anchor to be used with a basketball support pole, and more particularly to an anchor that facilitates ease of assembly and mounting of a basketball support pole and a backboard/hoop assembly attached thereto. The anchor may include an anchoring base and a lifting system. In use, the lifting system may rotatably attach to the support pole and allow a user to conveniently assemble and raise the basketball backboard/hoop assembly and support pole into a position for playing basketball.

3 Claims, 5 Drawing Sheets

U.S. PATENT DOCUMENTS

| | | | | | |
|---|---|---|---|---|---|
| 3,843,079 | A | | 10/1974 | Reisling | |
| 4,079,559 | A | * | 3/1978 | Tenbrummeler | 52/295 |
| 4,279,104 | A | | 7/1981 | Classen | |
| 4,307,887 | A | | 12/1981 | Weiss | |
| 4,395,040 | A | | 7/1983 | White | |
| 4,465,277 | A | | 8/1984 | Dittrich | |
| 4,522,394 | A | | 6/1985 | Broussard | |
| 4,643,422 | A | | 2/1987 | Cramblett | |
| 4,801,142 | A | | 1/1989 | Friesen | |
| 4,869,501 | A | | 9/1989 | Anastasakis | |
| 4,881,734 | A | | 11/1989 | Nye | |
| 4,903,442 | A | * | 2/1990 | Trommen | 52/116 |
| 4,940,232 | A | | 7/1990 | Chen | |
| 4,999,966 | A | | 3/1991 | Johnson | |
| 5,037,093 | A | | 8/1991 | Roark | |
| 5,211,393 | A | * | 5/1993 | Rolffs et al. | 473/484 |
| 5,316,315 | A | | 5/1994 | Roark | |
| 5,337,989 | A | | 8/1994 | Apple | |
| 5,398,478 | A | | 3/1995 | Gordin | |
| 5,417,511 | A | | 5/1995 | Warden | |
| 5,492,429 | A | | 2/1996 | Hodges | |
| 5,571,229 | A | | 11/1996 | Fitzsimmons | |
| 5,704,188 | A | | 1/1998 | Coulis | |
| 5,752,349 | A | | 5/1998 | Fitzsimmons | |
| 5,758,857 | A | | 6/1998 | Gray | |
| 2002/0007613 | A1 | | 1/2002 | Gordin | |

* cited by examiner

GROUND ANCHOR FOR SPORTS SUPPORT POLE

FIELD OF THE INVENTION

This invention relates to an anchor for use with a support pole, and more particularly to an anchor that facilitates ease of assembly and mounting of a basketball support pole and a backboard/hoop assembly attached thereto.

BACKGROUND OF THE INVENTION

When traveling through most neighborhoods, one can typically find a freestanding basketball goal structure erected in a neighborhood playground or adjacent to a residential driveway. When placed in the ground, these structures consist of a backboard/hoop assembly and a support pole of sufficient length so as to hold the backboard/hoop assembly at an appropriate height for playing basketball.

These basketball goals must be assembled and raised so that they are rigidly mounted in the ground. Typically, basketball backboard/hoop assemblies are very heavy and are supported by a metal support pole that may also be very heavy. In some basketball goal structures, the metal support pole may be filled at least partially with concrete so as to provide additional stability. However, the concrete may also add additional weight to the entire assembly.

When assembling a basketball goal, one traditional option is to assemble the backboard/hoop assembly and attach it to the support pole prior to raising the structure. One problem with this option is that the large, awkward shapes that comprise the various pieces of a basketball goal make assembly on the ground difficult. Additionally, because of the size and weight of both the backboard/hoop assembly and the support pole, it is difficult, if not impossible, for a single person to raise the entire assembly without the assistance of others. Generally, at least one person is needed to lift and hold the basketball goal structure while at least one other person attaches the structure to the ground.

A second option is to secure the support pole in or to the ground prior to mounting the backboard/hoop assembly onto the support pole. Once the support pole is sufficiently anchored in the ground, the backboard/hoop assembly may then be raised to the top of the support pole and mounted. This option requires that a heavy assembly be raised to a substantial height, often ten feet, to achieve an appropriate playing position. Because of the bulk and weight of the assembly, it is difficult, if not impossible, for a single person to mount the assembly without the assistance of at least one other person. Additionally, tools such as a ladder to support a person may be required.

One traditional solution for raising the basketball backboard/hoop assembly has been to use a lifting device such as a pulley system or ropes to raise the structure. However, this has not been effective because it is inconvenient for users who must set up the lifting device and also requires additional equipment and tools. Further, this method does not protect the structure from slipping and falling if the bottom of the support pole were to slip after being raised partially on one end. Hence, the assembly is not made any easier or less awkward.

Therefore, there is a need for a ground-anchor system for a basketball support pole that facilitates easier and less awkward assembly and mounting of a basketball goal structure.

SUMMARY OF THE INVENTION

This invention relates to an anchor for use with a support pole, and more particularly to an anchor that facilitates ease of assembly and mounting of a basketball support pole and a backboard/hoop assembly attached thereto.

One embodiment of the present invention may include a method for reinforcing a sports support pole with the method comprising the steps of anchoring a base having a front side and back side, connecting the back side of the base to the first end of the sports support pole such that the base and the sports support pole are rotatably connected and connecting a lifting member between the front side of the base and the first end of the sports support pole, the lifting member having an effective length such that shortening the effective length of the lifting member raises a second end of the sports support pole. The method may also include the step of shortening the effective length of the lifting member such that the second end of the sports support pole achieves a playing position.

Another embodiment of the present invention may include a ground anchor for a sports support pole comprising a sports support pole having a first end and a second end and an anchoring base having a first side and a second side, the first side and the second side being rotatably connected, the first side being attached to the first end of the sports support pole and the second side being anchored to support a sports apparatus. The ground anchor may further include a lifting system rotatably connected to the second side of the anchoring base and configured to connect to the first side of the anchoring base wherein adjustment of the lifting system raises the second end of the sports support pole. Another embodiment of the present invention may include a method of raising a sports support pole with the method comprising the step of anchoring a base having a first member and a second member, the first member and the second member of the anchoring base being rotatably connected and the first member of the base being attached to a first end of the sports support pole. The method may further comprise the step of connecting a lifting system to the first member and the second member of the base, the lifting system including a threaded rod and a lifting nut, such that tightening the lifting nut raises the sports support pole and loosening the lifting nut lowers the sports support pole. The may further comprise the step of tightening the lifting nut to raise the sports support pole to a playing position.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the figures in which various embodiments of the present invention are shown. The subject matter of this disclosure may, however, be embodied in many different forms and should not be construed as being limited to the embodiments set forth herein.

Figure 1:
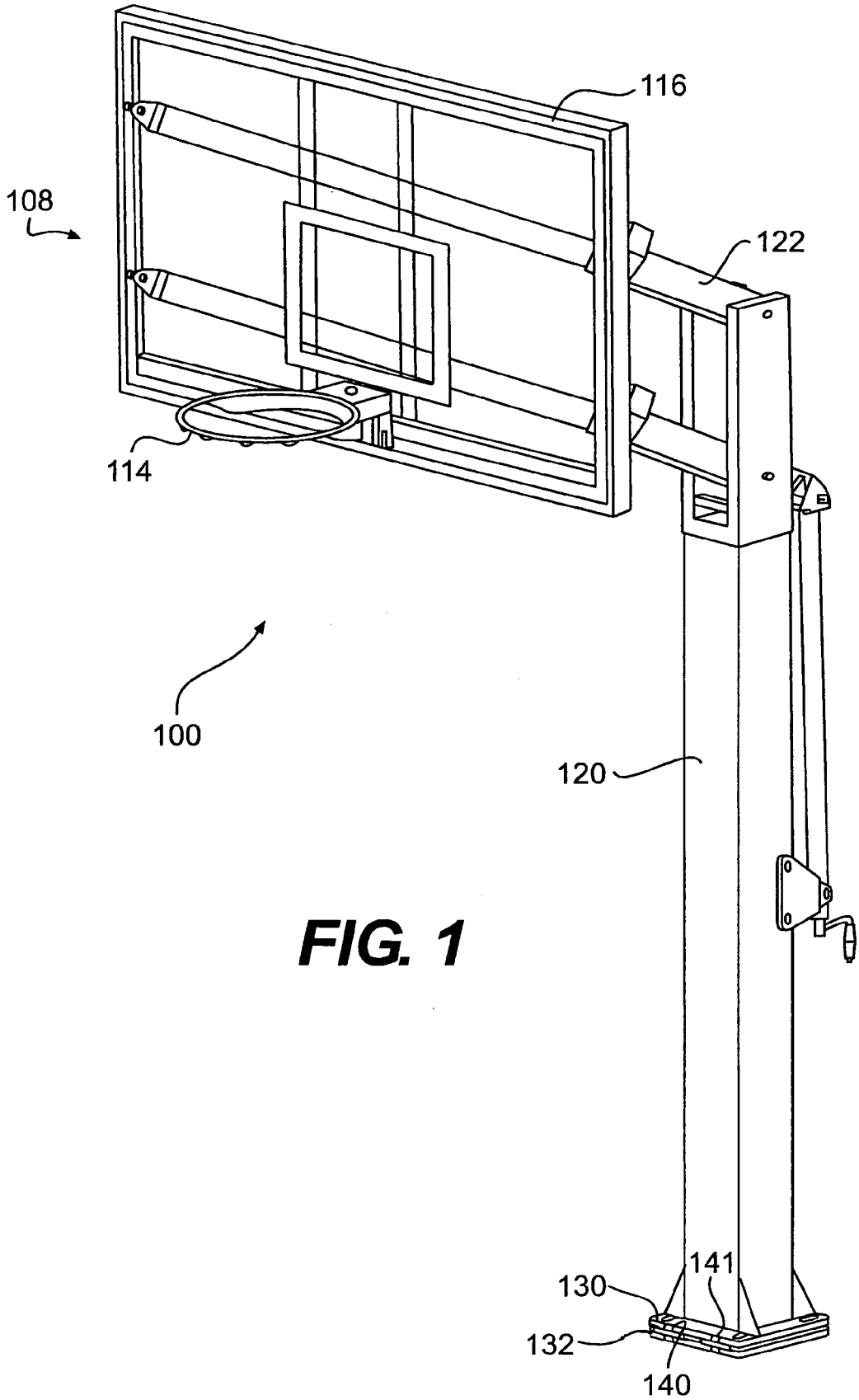
FIG. 1 shows a view of a typical backboard/hoop assembly attached to a support pole and anchored to the ground with the present invention.

FIG. 1 shows a view of a typical basketball backboard/hoop assembly attached to a support pole and anchored to the ground using the present invention. A basketball goal 100 may include a backboard assembly 108 which may be mounted to an upper portion of a support pole 120 by a plurality of support struts 122 in a conventional manner. The backboard assembly 108 may include a basketball hoop 114 secured to and extending outwardly from a backboard 116. Although the present invention is shown with an adjustable height backboard/hoop assembly with a support pole having a square cross-section, it is contemplated that any type of basketball goal assembly and a support pole having a cross-section of any shape may be used.

At the base of the support pole 120, an anchoring base having two plates 130, 132 may be used to attach the support pole 120 to the ground (not shown). While the ground may be taken generally to mean the earth, it is also contemplated that the support pole 120 may be attached to concrete, an indoor floor (such as an indoor gymnasium floor), asphalt or any basketball playing surface as would be known to one of skill in the art.

The first plate 130 of the anchoring base may be attached to the support pole 120 using bolts, rivets, screws or any means for mechanically fastening known in the art. Additionally, it is contemplated that the first plate 130 of the anchoring base may be welded to the support pole 120 or may be formed as an integral part of the support pole 120.

The second plate 132 of the anchoring base may be attached to the ground (not shown) using bolts, rivets, screws or any means for mechanically fastening known in the art. Additionally, it is contemplated that the second plate 132 may be welded or permanently attached to the ground in a manner known in the art. Further, the second plate 132 of the anchoring base may be attached to a lower support pole that may be conventionally mounted in the ground as known by one of ordinary skill in the art.

In alternative embodiments, the anchoring base may be located at different heights on the support pole 120 by using a lower support pole that may be set in the ground. Such embodiments may be desirable in situations where there is insufficient room at ground level (due to plant growth, for example) to position the plate 132 flush with the ground.

Two hinges 140, 141 may be used for connecting the first plate 130 and the second plate 132 of the anchoring base so that they may be rotatably attached to one another. While two hinges are shown in FIG. 1 for connecting the first plate 130 and the second plate 132, it is contemplated that a single hinge or more than two hinges may be used for connecting the plates 130, 132. Additionally, the placement of the hinges 140, 141 on the side of the plates 130, 132 facing the basketball backboard assembly 108 is not meant to be limiting; it is contemplated that the hinges 140, 141 may be placed on any of the sides of the anchoring base. Further, while the plates 130, 132 of the anchoring base are shown in FIG. 1 as square, any suitable shape for the plates is contemplated.

Although the present invention is described and shown with plates, or flange elements, connecting the support pole to the ground, alternative embodiments of the present invention may avoid the use of plates and directly connect the support pole 120 with a lower support pole (not shown) with a hinge or rotatable joint. For light and economic basketball goal production models, the use of flange plates (130 and 132 in FIG. 1) may be unnecessary to efficiently raise the basketball goal and support pole.

Figure 2A:
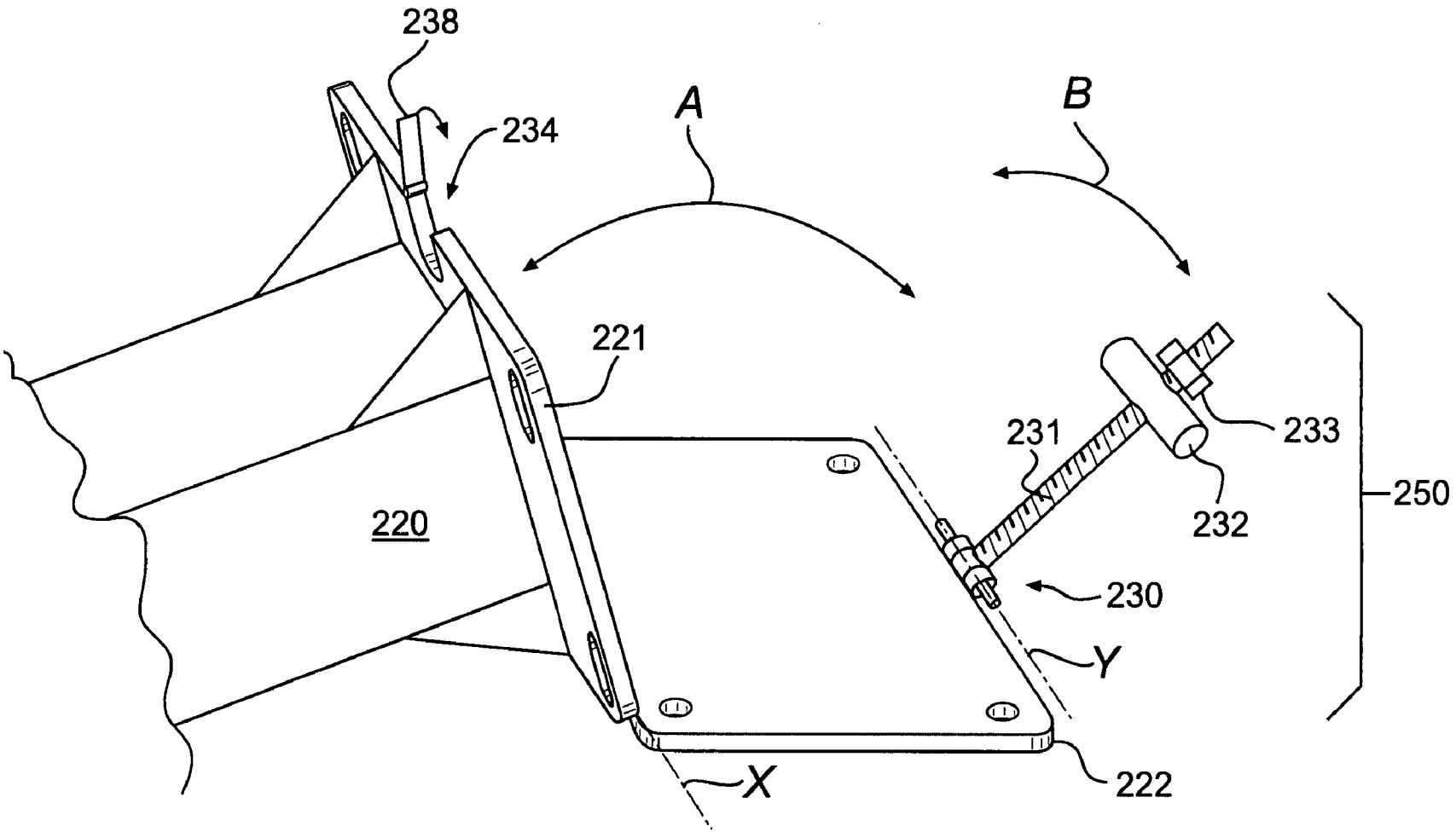
FIGS. 2A, 2B, 2C, 2D and 2E are various views of an embodiment of the present invention using the anchoring base shown in FIG. 1 for assembling and raising a basketball support pole and backboard/hoop assembly.
Figure 2B:
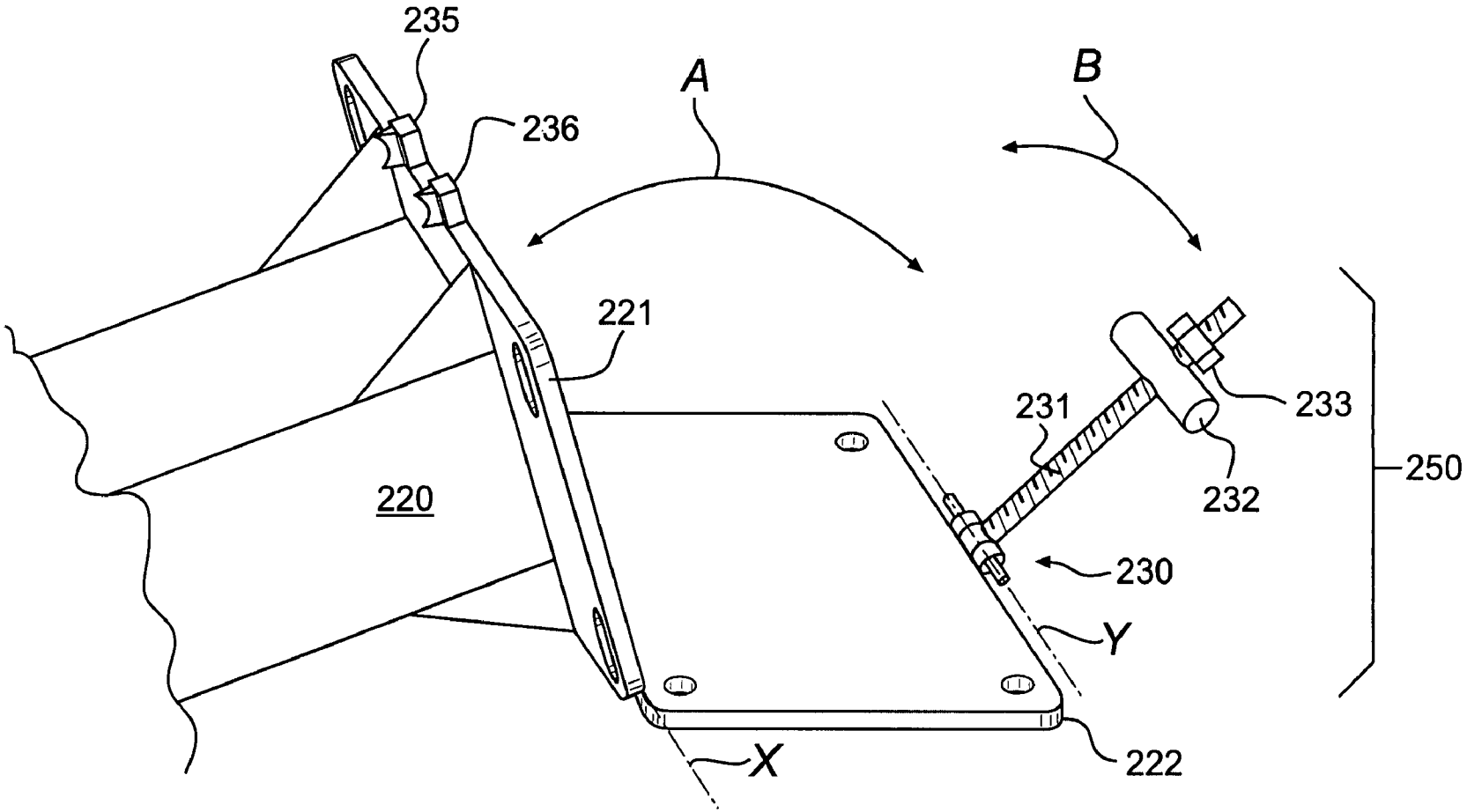
Figure 2C:
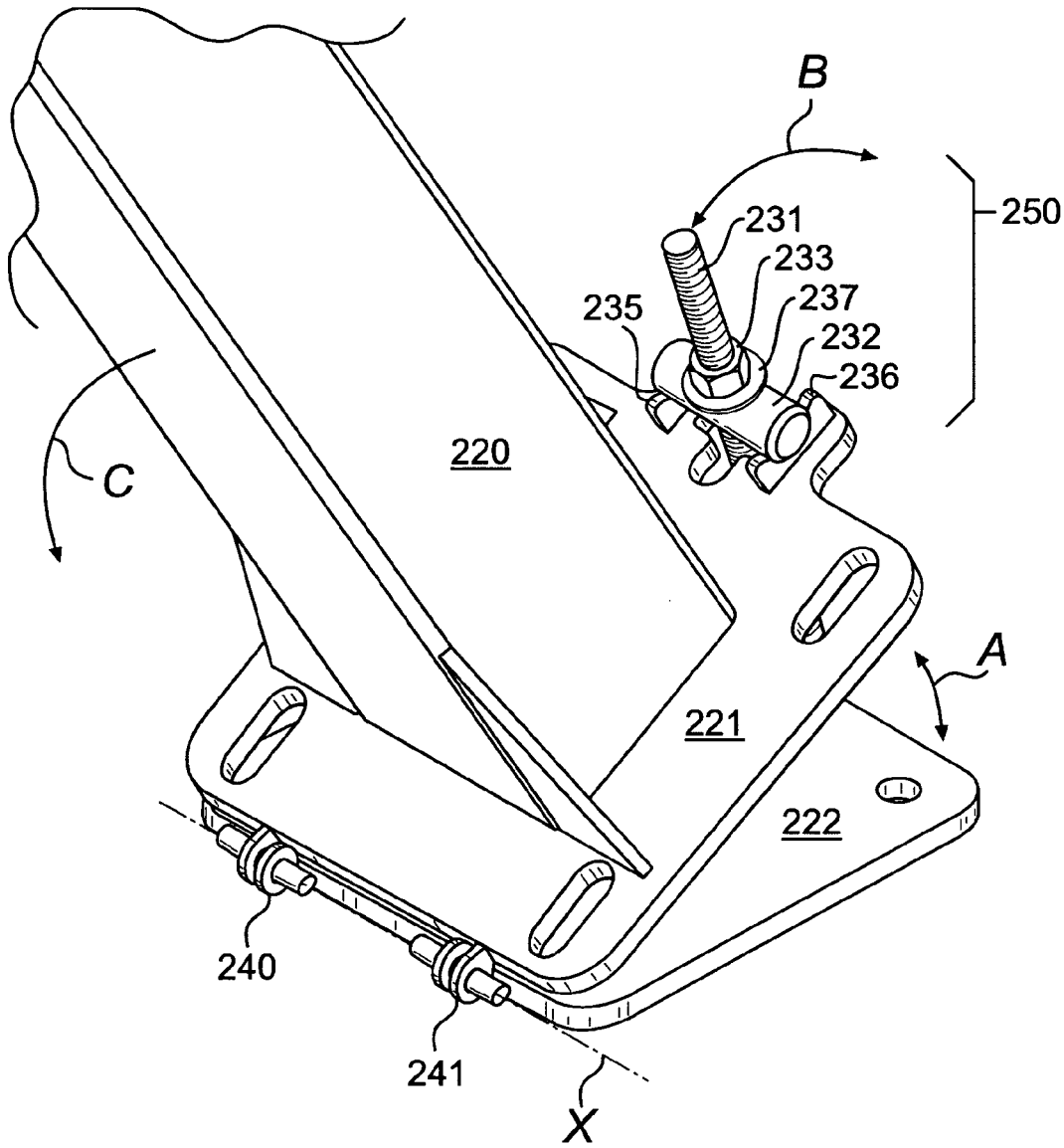

FIGS. 2A, 2B, 2C, 2D and 2E are various views of an embodiment of the present invention using the anchoring base shown in FIG. 1 for assembling and raising a basketball support pole and backboard/hoop assembly. An anchoring base having a first plate 221 and a second plate 222 and hinges 240, 241 enable a support pole 220 to rotate about line X along the directions illustrated by Arrow A. A lifting system 250 may include a threaded rod 231 with one end attached to a hinge 230 that may permit the threaded rod 231 to rotate about line Y along the directions shown by Arrow B. The lifting system 250 may include a lifting rod or bar 232 and a lifting nut 233. In one embodiment, a washer 237 (as shown in FIG. 2C) may be used. Although the lifting rod or bar 232 is shown in FIGS. 2A-2E as a solid barrel-shaped rod, it is contemplated that a large washer, square bar or a similar device may be used as long as the functionality of the present invention is retained. Further (and as discussed below), while the figures illustrate the use of a threaded rod 231, a lifting nut 233 and a lifting rod or bar 232, it is contemplated that any mechanical means for tightening may be used in the present invention. This may include, for example, a ratchet system, a jack system or other tightening means known to one of skill in the art.

As discussed above, prior to assembly of the basketball goal structure, the second plate 222 of the anchoring base may be attached to the ground (not shown) in a suitable manner. Once the anchoring base is suitably mounted, the support pole 220 and first plate 221 of the anchoring base may then be attached so as to pivot about the hinges 240, 241 in the directions shown by Arrow A. The hinges 240, 241 may permit the support pole to rest on the ground or at a predetermined height above the ground while it is still attached to the second plate 222 of the anchoring base. As discussed below, this may allow the backboard and basketball goal assembly to be assembled on the support pole 220 while the support pole 220 is on the ground or at a convenient height for the user, avoiding the necessity of ladders and other additional tools for assembly.

Figure 2E:
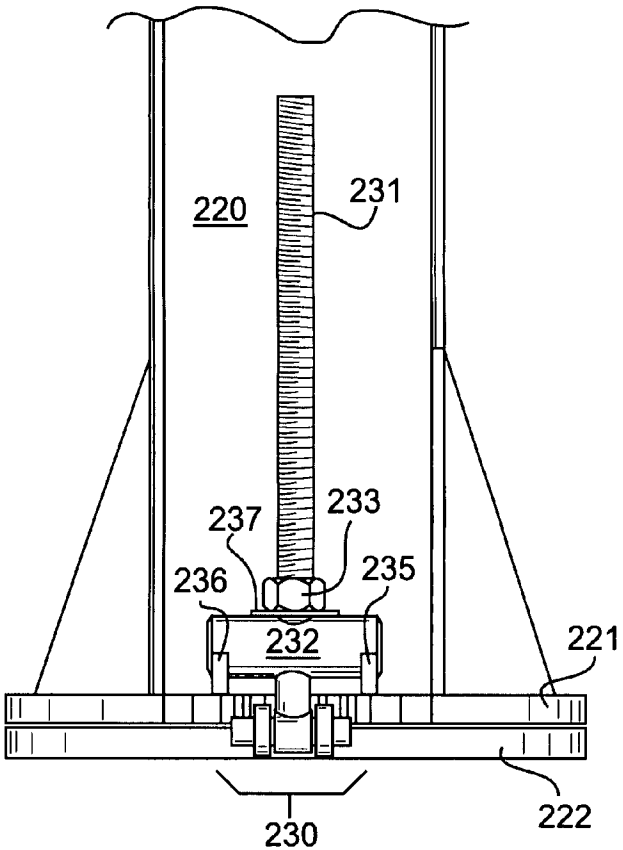
Figure 2D:
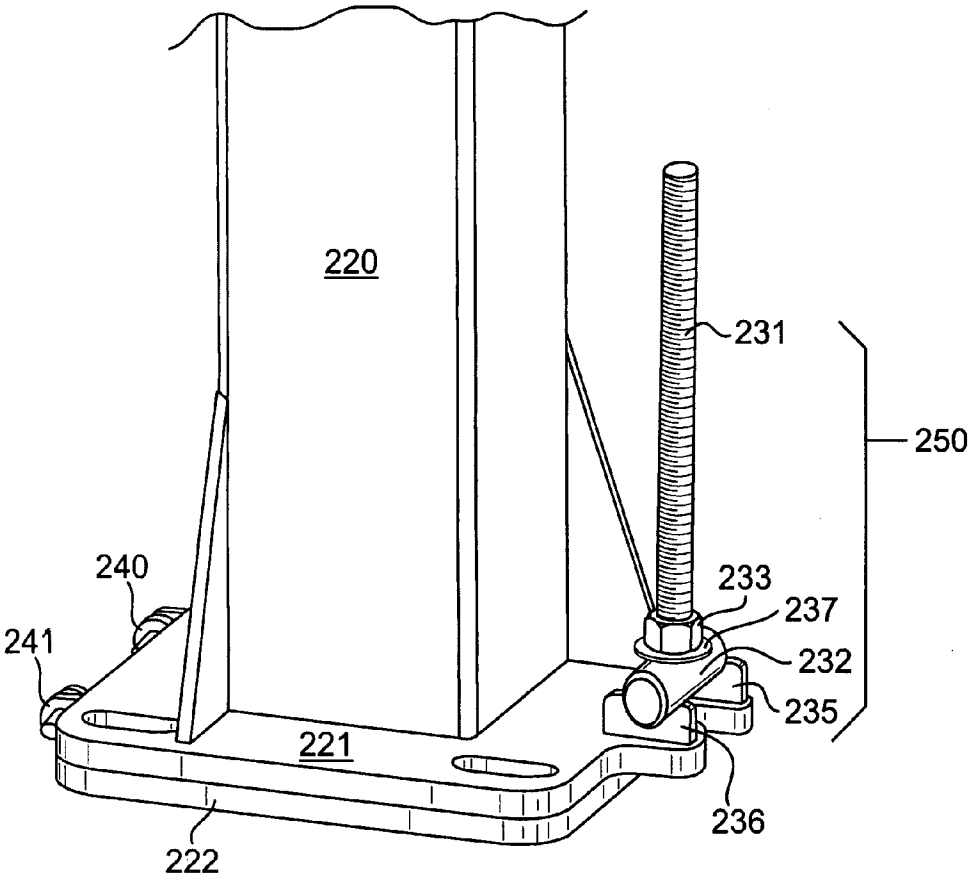

As shown in FIG. 2A, the first plate 221 of the anchoring base may include a receiving notch 234 of sufficient size so as to permit the threaded rod 231 to fit inside. In order to prevent the threaded rod from slipping from the notch 234 as the support pole 220 is raised, a lock or locking mechanism 238 may be included on the first plate 221, as shown in FIG. 2A. Alternatively, as shown in FIGS. 2B-2D, the first plate 221 of the anchoring base may include receiving portions 235, 236 mounted on two members protruding from the first plate 221. The receiving portions 235 and 236 may each include a saddle portion configured to hold the lifting bar 232 and may be sufficiently spaced apart so as to permit the threaded rod 231 to pass between them. Alternative embodiments of the connection between the lifting rod 231 and the first plate 221 may also be utilized without deviating from the scope and spirit of the present invention. For example, in FIG. 2A, the lifting bar 232 may be replaced with a large traditional washer (not shown) or other suitable element.

As shown in FIG. 2B, the support pole 220 and first plate 221 of the anchoring base may be rotated in the directions of Arrow A. By rotating the threaded rod 231 about line Y in the directions of Arrow B, the threaded rod 231 may be positioned between the two receiving portions 235, 236 such that the lifting bar 232 is positioned in the receiving portions 235, 236 as shown in FIG. 2C. The threaded rod 231 may be of sufficient length such that the lifting bar 232 may be positioned in the receiving portions 235, 236 when the support pole 220 is resting on the ground or positioned at a minimum angle with respect to the ground. This may allow a user to raise the support pole 220 using only the lifting system 250, thereby saving the user the effort of lifting the heavy support pole off the ground without assistance.

Once the lifting bar 232 is positioned in the receiving portions 235, 236, the support pole 220 may rest with its weight supported by the lifting system 250, as shown in FIG. 2C. As a result of this configuration, the support pole 220 may be prevented from moving or falling in the direction of Arrow C without a user first moving or adjusting the lifting system 250. Additionally, it is contemplated that the threaded rod 231 may be locked between the receiving portion 235, 236 using any type of locking mechanism known to those of skill in the art, such as the locking strap 238 illustrated in FIG. 2A for locking the threaded rod 231 inside of the notch 234.

As shown in FIG. 2C, by turning the lifting nut 233, the effective length of the threaded rod 231 (the distance from the hinge 230 to the lifting bar 232) may be adjusted to slowly raise and lower the support pole 220. To raise the support pole 220, the effective length of the threaded rod may be shortened by tightening the lifting nut 233, essentially pulling the first plate 221 into contact with the second plate 222. Although, the lifting system 250 is shown and described as a threaded rod 231 and nut 233 mechanism, other mechanisms may be used to raise the support pole 220, as discussed above. For example, a ratcheting system or jack system may be employed to pull the first plate 220 into contact with the second plate 222.

In one embodiment, a user may raise the support pole 220 to an angle of approximately 30 degrees such that the basketball goal or other sports apparatus may be conveniently assembled on the raised end of the support pole 220 by a user standing on the ground (not shown). At 30 degrees, the end of a ten-foot support pole may be positioned at a height of approximately five feet, allowing a user to assemble a sporting apparatus on the support pole without much difficulty. However, it is contemplated that the support pole may be raised and lowered using the lifting system 250 until the end of the support pole 250 is positioned at any suitable height for any user. By adjusting the height of the support pole, the use of a ladder or other additional tools may not be required during assembly. Additionally, securing the end of the support pole 220 at a convenient height during assembly eliminates the need to hoist and hold an awkward and heavy backboard/hoop assembly in the air for assembly. It should also be understood that the support pole may be raised and lowered to different heights during different stages of assembly, allowing the user to make adjustments to the working height as elements are assembled.

Once the backboard/hoop assembly is attached to the support pole, a user may then further shorten the effective length of the threaded rod 231 by turning the lifting nut 233 down the entire length of the threaded rod 231. This tightening may force the lifting bar 232 or a similar device, as discussed above, to the bottom of the threaded rod 231 and may raise the basketball goal into a substantially vertical position, as shown in FIGS. 2D and 2E. Thus, the use of the anchoring base and lifting system 250 may permit fewer people than have been traditionally required to hoist a large and heavy basketball goal into a playing position. Additionally, the system may be assembled and raised in a more convenient manner than with traditional systems.

Once the basketball goal is placed in a substantially vertical position, a user may then use screws, bolts, rivets, welding or other means for mechanically fastening known in the art (not shown) to secure the first plate 221 and the second plate 222 of the attachment base together. In turn, once the plates 221, 222 are securely fastened, the user may then remove the threaded rod 231 from the lifting system 250 by removing the hinge pin from the hinge 230. Alternatively, the threaded rod 231 may be configured in two connectable pieces so that the top portion may be detached and reattached for later adjustments.

In addition to using the anchoring base of the present invention for supporting an upright basketball goal, it is envisioned that the present invention can be utilized for raising and supporting a basketball goal permanently positioned at an angle. Further, it is contemplated that the present invention may be used as an anchoring base for other types of support poles. This may include support poles for volleyball nets, soccer goals, flagpoles or the like.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A ground anchor for a sports support pole, comprising:

a sports support pole having a first end and a second end;

an anchoring base having a first side and a second side, the first side and the second side being rotatably connected, the first side being attached to the first end of said sports support pole and the second side being anchored to support a basketball backboard and hoop assembly; and a lifting system rotatably connected to the second side of said anchoring base and configured to connect to the first side of said anchoring base, said lifting system including a threaded rod and a lifting nut threadably engaged with the threaded rod, such that tightening of the lifting nut raises the second end of said sports support pole;

wherein the first side of said anchoring base includes a lock to secure said lifting system to the first side of said anchoring base;

wherein adjustment of said lifting system raises the second end of said sports support pole to allow for assembly of the basketball backboard and hoop assembly at the second end of said sports support pole at a predetermined height above the ground.

2. The ground anchor of claim 1, wherein the first side of said anchoring base includes a receiving portion and the lifting system being configured to removably attach to the receiving portion.

3. The ground anchor of claim 1, wherein said anchoring base includes a means for securing the first side to the second side and wherein said lifting system is removable from the first side and the second side of said anchoring base.

* * * * *